US008488821B2

(12) United States Patent
Kral et al.

(10) Patent No.: US 8,488,821 B2
(45) Date of Patent: Jul. 16, 2013

(54) SNAP-ON FASTENING DEVICE FOR HEARING DEVICE

(75) Inventors: Holger Kral, Fürth (DE); Stefanie Preusche, Erlangen (DE); Joseph Sauer, Strullendorf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1036 days.

(21) Appl. No.: 12/072,846

(22) Filed: Feb. 28, 2008

(65) Prior Publication Data

US 2008/0212813 A1 Sep. 4, 2008

(30) Foreign Application Priority Data

Mar. 1, 2007 (DE) ..... 10 2007 010 011

(51) Int. Cl.
*H04R 25/00* (2006.01)

(52) U.S. Cl.
USPC ..... 381/312

(58) Field of Classification Search
USPC ..... 381/312
See application file for complete search history.

(56) References Cited

U.S. PATENT DOCUMENTS

| | | | | |
|---|---|---|---|---|
| 6,731,770 | B1 * | 5/2004 | Vonlanthen | 381/330 |
| 6,735,319 | B1 * | 5/2004 | Vonlanthen | 381/330 |
| 2004/0151331 | A1 * | 8/2004 | Vonlanthen | 381/315 |

FOREIGN PATENT DOCUMENTS

| | | | |
|---|---|---|---|
| CH | 689685 | A5 | 8/1999 |
| EP | 186748 | A2 | 7/1986 |
| EP | 1 715 722 | A2 | 10/2006 |

OTHER PUBLICATIONS

Communication from European Patent Office stating cited references, Dec. 2, 2011, pp. 1-6.

* cited by examiner

*Primary Examiner* — Steven Loke
*Assistant Examiner* — Jonathan Han

(57) ABSTRACT

With housing elements of a hearing device which are fastened to a frame for accommodating internal components of the hearing device, the use of a large number of additional parts is problematic because of the risk of losing parts. In accordance with the invention a snap-on fastening means is used to fasten a housing element to the frame of the hearing device, with an opening being provided in the housing element and the frame for accommodating the snap-on fastening means.

10 Claims, 2 Drawing Sheets

SNAP-ON FASTENING DEVICE FOR HEARING DEVICE

CROSS REFERENCE TO RELATED APPLICATIONS

This application claims priority of German application No. 10 2007 010 011.8 filed Mar. 1, 2007, which is incorporated by reference herein in its entirety.

FIELD OF THE INVENTION

The invention relates to a snap-on fastening device of a hearing device.

BACKGROUND OF THE INVENTION

With housing elements (shells) of a hearing device which are fastened to a frame for accommodating internal components of the hearing device, the use of large numbers of additional parts is problematic because of the risk of losing parts.

Housing fastenings on the frame by a number of snap-on connections cannot be used for reasons of size dimensioning.

The complex frame must be fixed in the hearing device housing and also be able to be easily and quickly released when the housing (shell) is changed.

Previously the frame has been supported directly in one housing shell with the shells then being screwed together. Another solution is to use pins which are pushed through the frame and the housing.

SUMMARY OF THE INVENTION

With housing elements of a hearing device which are fastened to a frame for accommodating internal components of the hearing device, the use of a large number of additional parts is problematic because of the risk of losing parts. The object of the invention is therefore to provide a snap-on fastening means that is used to fasten a housing element to the frame of the hearing device, with an opening being provided in the housing element and the frame for accommodating the snap-on fastening means.

BRIEF DESCRIPTION OF THE DRAWINGS

The invention is also shown in the form of a drawing comprising three figures.

DETAILED DESCRIPTION OF THE INVENTION

Figure 1:
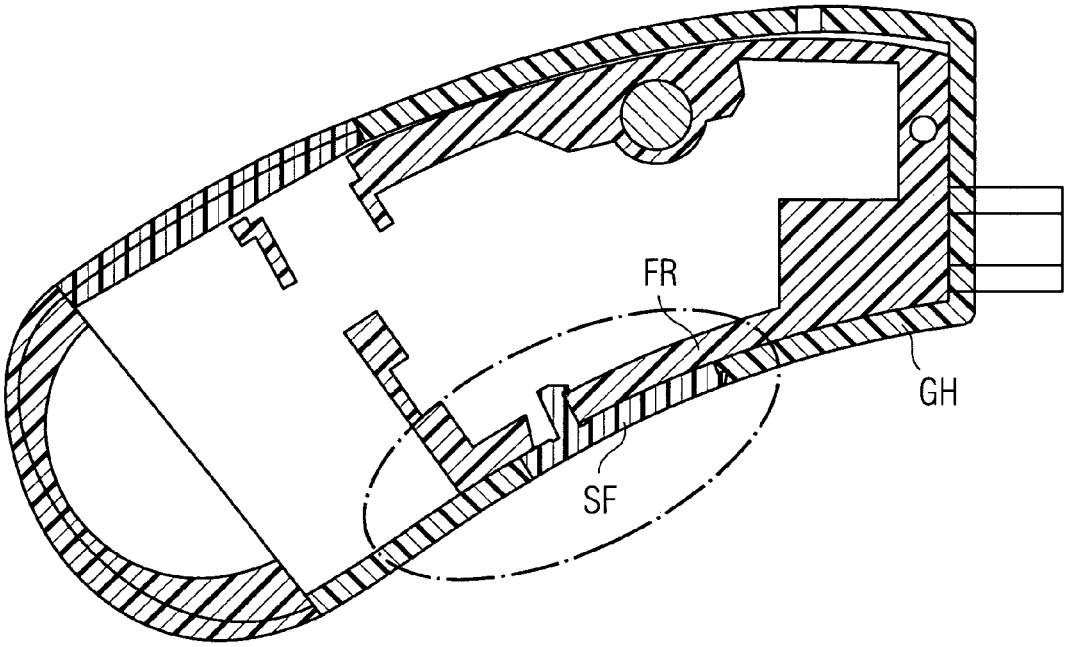
FIG. 1 shows a cross-sectional diagram of the hearing device without the electrical components, i.e. a housing element GH, a frame FR and a snap-on fastening element SF in the snapped-on state.
Figure 2:
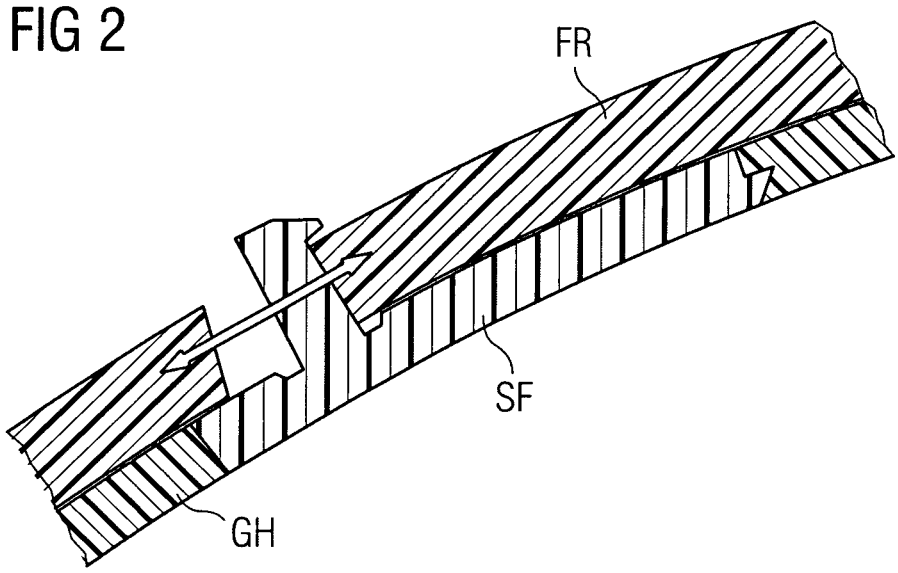
FIG. 2 shows a cross-sectional diagram of the hearing device in detail, with the snap-on fastening SF in the snapped-on state.
Figure 3:
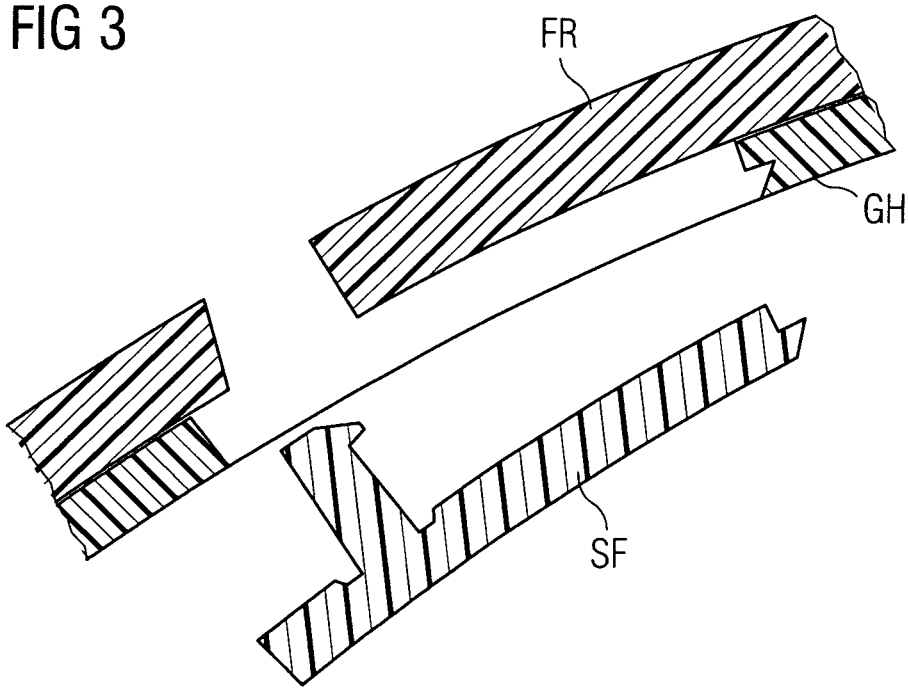
FIG. 3 shows a cross-sectional diagram of the hearing device in detail, with the snap-on fastening element SF shown removed from the snap-on opening.

In accordance with the invention a snap-on fastening means for fastening a housing element (shell) to the frame of the hearing device is used, with an opening being provided in the housing element and the frame for accommodating the snap-on fastening means, and with the snap-on spring of the snap-on fastening means being embodied so as to reach through the opening of the housing element and of the frame and to snap onto the frame, which simultaneously fixes the frame.

The advantage of the invention is that no pins or screws which disturb the design are used on the housing and that no size problems arise.

In a variant of the invention the snap-on fastening means is simultaneously employed as the type designation plate. That part of the snap-on fastening means SF which is used as the type designation plate locates in the opening in the housing. The result of this is to integrate the type designation plate in the snap-on fastening means.

In a further variant or embodiment of the invention two housing shells can be used which are fitted onto one side (e.g. upper side) of the frame and on the other side (e.g. lower side) are held together by the snap-on fastening means, with the frame being fixed at the same time by the snap-on fastening means.

The invention claimed is:

1. A hearing device, comprising:

a frame to support at least one component of the hearing device, the frame having at least two mutually opposite frame edges spaced-apart from one another, the spaced-apart frame edges defining an opening in the frame;

a housing to accommodate the frame, the housing having at least two mutually opposite housing edges spaced-apart from one another, the spaced-apart housing edges defining a gap in the housing, wherein the gap in the housing is configured to subtend the opening and extend beyond the spaced-apart frame edges;

a snap-on fastener formed by a non-hollow structure comprising a body and a snap-on fastening spring extending perpendicular from the body, the body configured to close the gap in the housing and further configured to provide a continuous contour to the housing, the snap-on fastening spring configured to pass through the opening in the frame to directly mechanically interlock the housing, the frame and the fastener to one another, the snap-on fastening spring having a latch to secure the fastening spring to the frame;

a shoulder located proximate to a first end of the body of the snap-on fastener and arranged to engage a corresponding outer surface of the frame; and a projection located at a second end of the body of the snap-on fastener, the projection configured to engage a corresponding indentation constructed in one of the housing edges of the housing.

2. The hearing device as claimed in claim 1, wherein an outer surface of the body of the snap-on fastener comprises a type designation plate.

3. The hearing device as claimed in claim 1, wherein the housing comprises two housing elements.

4. The hearing device as claimed in claim 3, wherein one of the two housing elements is fitted on an upper side of the frame and another one of the two housing elements is fitted on a lower side of the frame.

5. The hearing device as claimed in claim 4, wherein the two housing elements are held together by the snap-on fastener.

6. The hearing device as claimed in claim 1, wherein the snap-on fastener simultaneously anchors at least a portion of the frame in correspondence with the body of the snap-on fastener when the snap-on fastening spring is snapped onto the frame.

7. A method for fastening a housing element to a frame of a hearing device, comprising:

arranging in a frame at least two mutually opposite frame edges spaced-apart from one another, the spaced-apart frame edges defining an opening in the frame;

disposing a housing to accommodate the frame;

arranging in the housing at least two mutually opposite housing edges spaced-apart from one another, the spaced-apart housing edges defining a gap in the housing;

configuring the gap in the housing to subtend the opening and extend beyond the spaced-apart frame edges;

forming a snap-on fastener comprising a non-hollow structure;

arranging in the non-hollow structure of the snap-on fastener a body and a snap-on fastening spring extending perpendicular from the body;

configuring the body of the snap-on fastener to close the gap in the housing and further configuring the body of the snap-on fastener to provide a continuous contour to the housing;

configuring the snap-on fastening spring to pass through the opening in the frame for directly mechanically interlocking the housing, the frame and the fastener to one another; and securing the fastening spring to the frame by way of a latch constructed in the fastening spring.

8. The method as claimed in claim 7, further comprising simultaneously anchoring at least a portion of the frame in correspondence with the body of the snap-on fastener when snapping on the snap-on fastening spring onto the frame.

9. The method as claimed in claim 7, further comprising defining proximate to a first end of the body of the snap-on fastener a shoulder to engage a corresponding outer surface of the frame.

10. The method as claimed in claim 9, further comprising defining at a second end of the body of the snap-on fastener a projection to engage a corresponding indentation constructed in one of the housing edges.

* * * * *